United States Patent [19]

Rhoades et al.

[11] 4,122,792

[45] Oct. 31, 1978

[54] AERODYNAMIC DEVICE, PARTICULARLY FOR SAILS

[76] Inventors: John S. Rhoades, P.O. Box 197, Exton, Pa. 19341; Patricia G. Rhoades, 38 Elm St., Marblehead, Mass. 01945

[21] Appl. No.: 830,329

[22] Filed: Sep. 2, 1977

[51] Int. Cl.[2] ..... B63H 9/04

[52] U.S. Cl. ..... 114/103

[58] Field of Search ..... 114/39, 102–115; 244/130, 198, 200, 204

[56] References Cited

U.S. PATENT DOCUMENTS

| | | | |
|---|---|---|---|
| 640,116 | 12/1899 | Duthie | 114/103 |
| 1,864,964 | 6/1932 | Vaile | 114/103 |
| 3,174,453 | 3/1965 | Lemoigne | 114/103 |

*Primary Examiner*—Trygve M. Blix
*Assistant Examiner*—Jesus D. Sotelo
*Attorney, Agent, or Firm*—Morse, Altman, Oates & Bello

[57] ABSTRACT

An aerodynamic device mounted to a mainsail at the area of maximum air activity includes a venturi and a plurality of vertically disposed strips or offsets defining extending fins. The flow axis of the venturi is substantially parallel to the foot of the mainsail and the vertical fins are disposed in a substantially horizontal row along the venturi flow axis. Certain ones of the fins are positioned respectively forward and after the venturi and other ones of the fins are superimposed on the venturi. The aerodynamic device is operative to reach the free air layer beyond the zero activity and turbulent air layers for greater air drive and improved on-wind direction.

11 Claims, 8 Drawing Figures

AERODYNAMIC DEVICE, PARTICULARLY FOR SAILS

BACKGROUND OF THE INVENTION

1. Field of the Invention

The present invention relates to aerodynamic devices and, more particularly, is directed towards aerodynamic devices for sails.

2. Description of the Prior Art

The force which drives a sailboat to windward is similar to the force which gives lift to a glider's wing. The airfoil characteristics of a sail is achieved by building a fore-to-aft parabolic curve into the sail. The curvature is greatest near the luff or forward edge of the sail and becomes straighter near the leech, or after edge of the sail. When a boat reaches to windward, air flows around the sails from luff to leech. As the wind meets the luff, it splits to form a windward airflow and a leeward airflow. The molecules of air on the leeward side have a greater distance to travel around the sail than the molecules of air on the windward side. The speed of the leeward air flow is greater than the speed of the windward air flow. As a result of this difference between windward and leeward airflow speeds, the pressure is lower on the leeward side of the sail and a suction pull is created which draws the boat forward.

Addition of a jib in close proximity to the mainsail has a considerable influence on windflow. A correctly trimmed jib set ahead of the mainsail creates a narrow slot between the jib's leech and the mainsail's luff which acts as a venturi to accelerate the leeward airflow and to lower the pressure at the leeward side of the mainsail. In consequence, the suction pull on the mainsail is increased.

SUMMARY OF THE INVENTION

An object of the invention is to provide an aerodynamic device for increased leeward airflow about a sail.

Another object of the invention is to provide an aerodynamic device for a sail which produces greater air drive and improved on-wind direction.

A further object of the invention is to provide an aerodynamic device that is mounted to opposite faces of a sail at maximum air activity areas on the leeward side. The aerodynamic device includes a plurality of vertical strips or offsets defining extending fins that are disposed in a row that is substantially parallel to the foot of the sail. The fins are operative to reach the free air layer beyond the zero activity and turbulent air layers for greater air drive as well as improved on-wind direction.

Yet another object of the invention is to provide an aerodynamic device that is mounted to opposite faces of a mainsail. The aerodynamic device includes a venturi and a plurality of vertical strips or offsets that extend outwardly from the mainsail at areas of maximum air activity on the leeward side. The flow axis of the venturi is substantially parallel to the foot of the mainsail. The strips define vertically extending fins which are disposed in a substantially horizontal row along the venturi flow axis. At least one fin is positioned forward of each venturi inlet, at least one fin is located after each venturi outlet, and the remaining fins are superimposed on each venturi. The aerodynamic device is operative to reach the free air layer for greater air drive and improved on-wind direction.

Other objects of the present invention will in part be obvious and will in part appear hereinafter.

The invention accordingly comprises the devices and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 2:
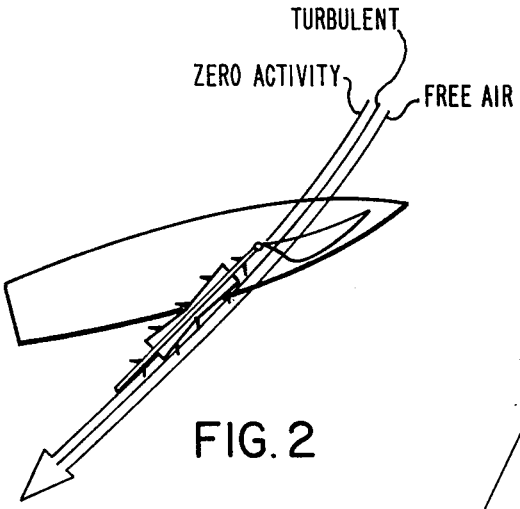
FIG. 2 is a schematic diagram illustrating certain principles of the invention shown in FIG. 1.
Figure 1:
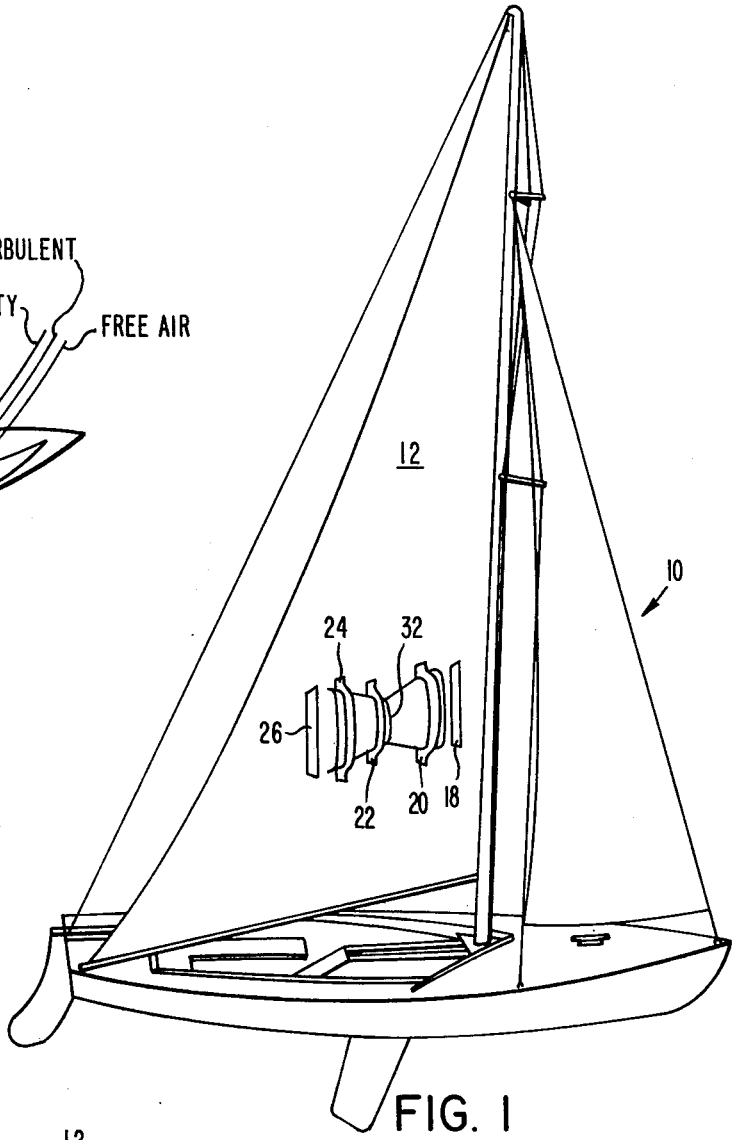
FIG. 1 is a perspective view of a sailboat having a mainsail with an aerodynamic device embodying the present invention.

Referring now to the drawings, particularly FIG. 1, there is shown a sailboat 10 with a mainsail 12 having an aerodynamic device 14 embodying the present invention. It is to be understood that, in alternative embodiments, sailboat 10 is other than a sloop, for example a ketch, a yawl, a schooner, a cat boat or other type sailing vessel. As schematically illustrated in FIG. 2, aerodynamic device 14 is operative to reach the free air layer beyond the zero activity and turbulent air layers in order to increase the airflow speed across the leeward side of mainsail 12. As a result of the increased leeward airflow speed, the pressure is lowered on the leeward side of mainsail 12 and increased suction is created which draws sailboat 10 forward. It is to be understood that, while reference is made to a mainsail, the scope of the invention is intended to include the incorporation of the aerodynamic device on sails other than a mainsail.

Figure 5:
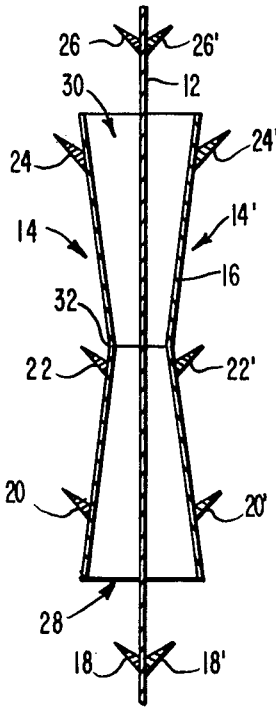
FIG. 5 is a sectional view taken along the lines 5—5 of FIG. 3.
Figure 4:
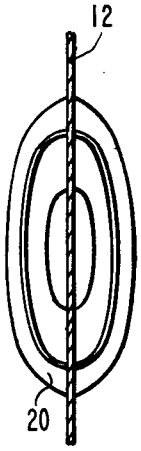
FIG. 4 is a sectional view taken along the lines 4—4 of FIG. 3.
Figure 3:
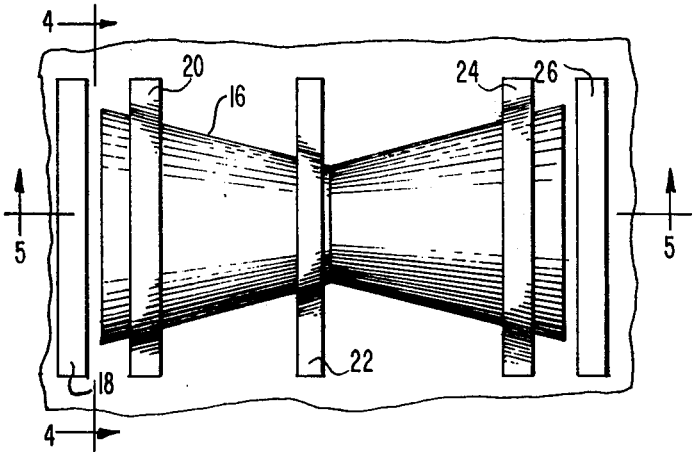
FIG. 3 is a side elevation of the venturi and fins of FIG. 1.

In FIG. 1, aerodynamic device 14 is on the leeward side of mainsail 12. As shown in FIGS. 4 and 5, the windward side of the mainsail 12 has a corresponding aerodynamic device 14' which is similar in function and structure to aerodynamic device 14. It will be readily apparent to those skilled in the art that corresponding aerodynamic devices on opposite faces of the mainsail are necessary for tacking. It is believed that the aerodynamic on the windward side will become flattened in the windward sail hollow. The following description of aerodynamic device 14 applies to aerodynamic device 14', corresponding parts of the device being denoted by like reference characters and distinguished by a prime notation.

Aerodynamic device 14 includes a venturi 16 and a plurality of vertical strips or offsets 18, 20, 22, 24 and 26. In the illustrated embodiment, venturi 16 is a sleeve having a somewhat flattened C-shaped profile in right cross section with an enlarged entrance port 28, an enlarged exit port 30 and a constricted medial portion 32. Venturi 16 is composed of a flexible material for example a stiffened sailcloth or a stiffened fabric composed of synthetic fibers made by the condensation of dimethyl terephthalate and ethylene glycol. In alternative embodiments, the cross-sectional profile of venturi 16 has other than a somewhat flattened C-shaped profile, a semi-circular profile, a trapezoidal profile or a rectangular profile. Strips 18, 20, 22, 24 and 26 are composed of a flexible, stiff material such as stiffened sailcloth or formed of synthetic fibers made by the condensation of dimethyl terephthalate and ethylene glycol, for example, and define outwardly and rearwardly extending fins having a substantially triangular shape in right cross section. Fins 18, 20, 22, 24 and 26 are stiffened to maintain their rearwardly pointing posture in the presence of airflow. Fin 18 is positioned forwardly of entrance port 28 and fin 26 is disposed rearwardly of exit port 30, the fins being attached to mainsail 12. Fins 20, 22 and 24, which are superimposed on and envelop venturi 16, are attached thereto and to mainsail 12 by a suitable adhesive or by stitching, for example.

Aerodynamic device 14, which is disposed at the area of maximum air activity is positioned at a lower portion of mainsail 12. That is, aerodynamic device 14 is located in the area of acute wind drive concentration on the leeward side. In the illustrated embodiment, aerodynamic device 14 is approximately three to five feet in height, extends laterally a distance of approximately two to four feet, and is positioned a distance from the foot of mainsail 12 of approximately twelve and one half percent of the height of the mainsail. The flow axis or longitudinal axis of venturi 16 is in substantially parallel relationship to the foot of mainsail 12, entrance port 28 being closer to the luff of the mainsail than exit port 30 is to the leech. Fin 18 is positioned between the luff of mainsail 12 and entrance port 28. Fin 26 is located between the leech of mainsail 12 and exit port 30. Fins 18, 20, 22, 24 and 26 are in spaced parallel relationship to one another and are disposed is a substantially horizontal row that is centered along the flow axis of venturi 16.

As previously indicated, the combination of venturi 16 and extending fins 18, 20, 22, 24 and 26 are operative to increase the airflow across the leeward side of mainsail 12. In consequence, an increased suction force is created on the leeward side which increases the forward pull on sailboat 10. It is believed that venturi 14' and fins 18', 20', 22', 24' and 26' on the windward side of mainsail 12 will not hinder airflow. Aerodynamic device 14 is operative to reach the free air layer beyond the zero activity and turbulent layers of air flowing past mainsail 12 for greater air drive as well as improved on-wind direction. The height of venturi 16 from the surface of mainsail 12 is less than 3 inches. The boundary layer (inactive and turbulent layers) are within a maximum of 3 inches from the mainsail and the free air layer begins at 3 inches from the mainsail.

Although it is not known with certainity, it is believed that aerodynamic device 14 will, in addition to increasing airflow across the leeward side of mainsail 12, shift further aft the normal turbulence caused by the juncture of the windward and leeward airflows at the leech of the mainsail and thereby improving the leech-end turbulence/drag factor.

Figure 6:
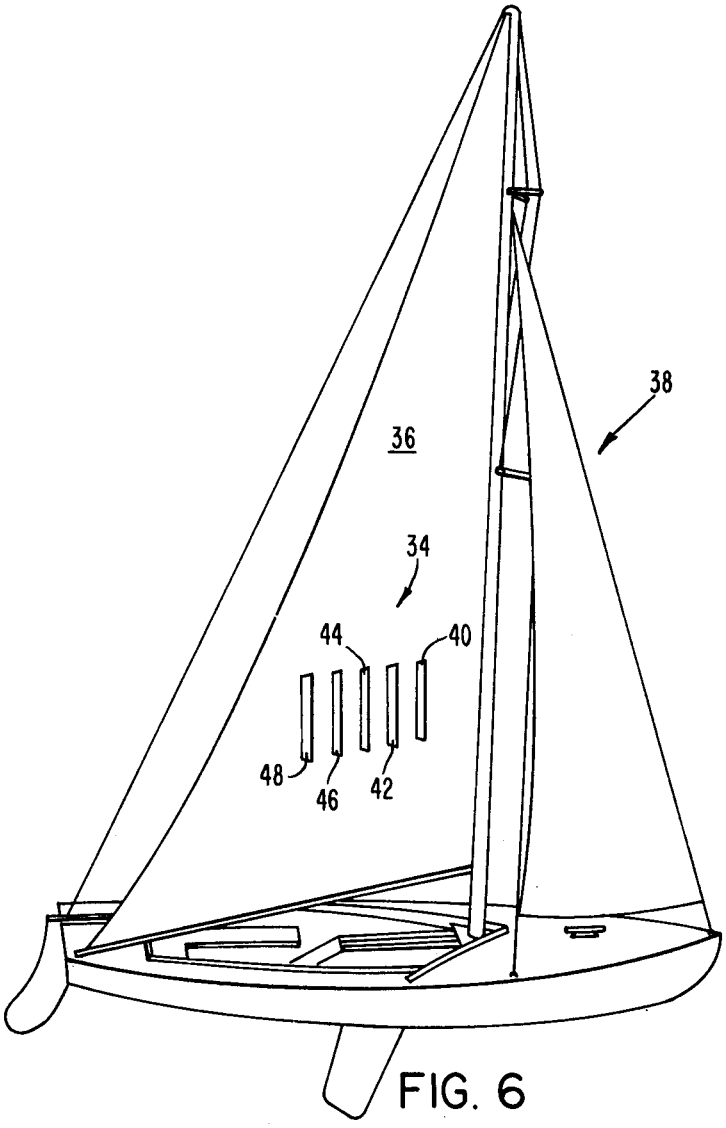
FIG. 6 is a perspective view of an alternate embodiment of the invention.
Figure 7:
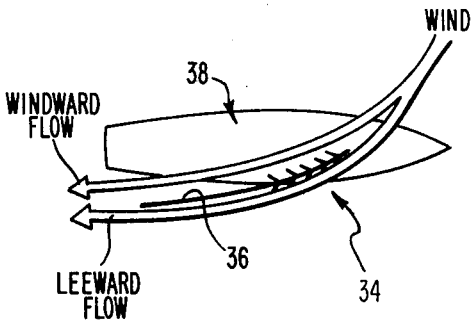
FIG. 7 is a schematic diagram illustrating certain principles of the invention shown in FIG. 6.
Figure 8:
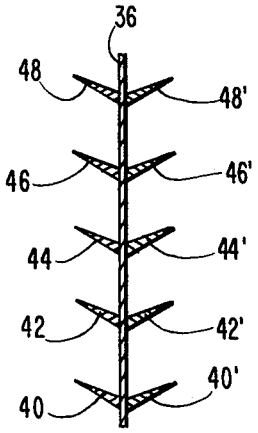
FIG. 8 is a sectional view of the fins of FIG. 6.

Referring now to FIGS. 6, 7 and 8, there is shown an aerodynamic device 34 which is attached to the leeward side of a mainsail 36 of a sailboat 38. Aerodynamic device 34 includes a plurality of vertically disposed strips 40, 42, 44, 46 and 48 defining outwardly extending fins.

As indicated in FIGS. 7 and 8, the windard side of mainsail 36 is provided with an aerodynamic device 34' which corresponds in function and structure to aerodynamic device 34. The following description of aerodynamic device 34 applies to aerodynamic device 34', corresponding part of the devices being denoted by like reference characters and distinguished by a prime notation. It will be readily apparent to those skilled in the art that corresponding aerodynamic devices on opposite face of the mainsail are necessary for tacking.

Fins 40, 42, 44, 46 and 48 are disposed in a substantially horizontal row that is in spaced parallel relationship with the foot of mainsail 36 in the area of maximum air activity. As shown in FIGS. 7 and 8, fins 40, 42, 44, 46 and 48 have a substantially triangular shape in right cross section and slant toward the leech of mainsail 36. Fins 40, 42, 44, 46 and 48 are composed of a stiffened flexible material such as a stiffened sailcloth or a fabric formed of synthetic fibers made by the condensation of dimethyl terephthalate and ethelyne glycol and are attached to mainsail 36 by suitable means such as an adhesive or by stitching, for example. The distance between aerodynamic device 34 and the luff of mainsail 36 is less than the distance between the aerodynamic device and the leech of the mainsail. That is, fin 40 is closer to the luff of mainsail 36 than fin 48 is to the leech of the mainsail. Fins 40, 42, 44, 46 and 48 extend outwardly from mainsail 36 less than three inches and are operative to reach the free air layer which is beyond the zero activity and turbulent air layers. As schematically illustrated in FIG. 7, when the wind meets the luff of mainsail 12 it splits to form a windward airflow and a leeward airflow. Fins 40, 42, 44, 46 and 48 increase the speed of the molecules of air on the leeward side by reaching into the free air layer. As a result of the difference between the windward and leeward airflow speeds, the pressure on the leeward side of mainsail 36 is lowered and an increased suction pull is created which moves sailboat 38 at a greater speed.

It will be apparent from the foregoing description that the invention provides an aerodynamic device, particularly for sails, which reaches into the free air layer for greater air drive as well as improved on-wind direction.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A device for increased utilization of airflow across the leeward side of a sail, said device comprising:

(a) venturi means configured to be attached to the leeward side of a sail; and (b) a plurality of extending fin means, at least one of said fin means configured to be attached to said sail between the luff and said venturi means, at least one of said fin means configured to be attached to said sail between the leech and said venturi means, other ones of said fin means superimposed on said venturi means and attached thereto and to said sail.

2. The device as claimed in claim 1 wherein said venturi means has an enlarged entrance port, an enlarged exit port and a constricted medial portion, a longitudinal axis of said venturi means disposed in substantially parallel relationship with a foot of said sail.

3. The device as claimed in claim 2 wherein the distance between said entrance port and said luff is less than the distance between said exit port and said leech.

4. The device as claimed in claim 3 wherein said venturi means is composed of stiffened, flexible material.

5. The device as claimed in claim 2 wherein said fin means are disposed in a substantially horizontal row along said longitudinal axis of said venturi means.

6. The device as claimed in claim 5 wherein each said fin means extends outwardly and rearwardly from said sail.

7. In combination with a sail, an aerodynamic device for increased utilization of airflow across said sail, said device comprising a plurality of rearwardly extending, vertical fins disposed in a substantially horizontal row between the luff and the leech in substantially parallel relationship with a foot of said sail at an area of maximum air activity, the height of said row of fins extending a distance that is substantially less than the distance between the head and foot of said sail, each of said fins extending outwardly from said sail, one of said fins adjacent said luff and another one of said fins adjacent said leech, the distance between said one fin and said luff being less than the distance between said other fin and said leech, said fins operative to reach the free air layer beyond the zero activity and turbulent air layers flowing across said sail.

8. In combination with a sail, an aerodynamic device for increased utilization of airflow across said sail, said device comprising:

(a) a plurality of vertical fins disposed in a substantially horizontal row between the luff and the leech in substantially parallel relationship with a foot of said sail at an area of maximum air activity, each of said fins extending outwardly from said sail, one of said fins adjacent said luff and another one of said fins adjacent said leech, the distance between said one fin and said luff being less than the distance between said other fin and said leech, said fins operative to reach the free air layer beyond the zero activity and turbulent air layers flowing across said sail; and (b) venturi means having an entrance port, an exit port and a constricted medial region, said plurality of fins disposed along a longitudinal axis of said venturi means, said longitudinal axis substantially parallel to a foot of said sail, said venturi means disposed between the luff and the leech of said sail closer to said luff, said venturi means and said fins operative to reach the free air layer beyond the zero activity and turbulent air layers of air flowing across said sail.

9. The aerodynamic device as claimed in claim 8 wherein said venturi means includes a first venturi and a second venturi, said first venturi attached to one face of said sail, said second venturi attached to an opposite face of said sail, said fins mounted on both faces of said sail along an airflow axis through each said venturi.

10. The aerodynamic device as claimed in claim 9 wherein said venturi means and said fins are composed of stiffened sailcloth.

11. A device for increased utilization of airflow across a sail, said device comprising:

(a) venturi means configured to be attached to said sail; and (b) at least two extending fin means, one of said fin means configured to be attached to said sail between the luff and said venturi means, the other one of said fin means configured to be attached to said sail between the leech and said venturi means.

* * * * *